United States Patent [19]

Leblond

[11] Patent Number: 4,524,894

[45] Date of Patent: Jun. 25, 1985

[54] METHOD AND APPARATUS FOR FORMING PATTERN PIECES

[75] Inventor: Claude W. Leblond, Enfield, Conn.

[73] Assignee: Gerber Garment Technology, Inc., South Windsor, Conn.

[21] Appl. No.: 454,431

[22] Filed: Dec. 29, 1982

[51] Int. Cl.[3] ..... B26F 3/00

[52] U.S. Cl. ..... 225/2; 225/96; 83/875; 83/879; 83/565

[58] Field of Search ..... 83/875, 879, 565; 225/96, 2

[56] References Cited

U.S. PATENT DOCUMENTS

| | | | |
|---|---|---|---|
| 3,522,753 | 8/1970 | Schmied | 83/471.2 |
| 3,537,345 | 11/1970 | Luppino | 83/565 |
| 3,548,699 | 12/1970 | Gerber | 83/528 |
| 3,555,944 | 1/1971 | Imamura | 83/565 |
| 3,567,086 | 3/1971 | Wark | 225/2 |
| 3,613,974 | 10/1971 | Chatelain | 83/565 |
| 3,668,956 | 6/1972 | Whipple et al. | 83/881 |
| 3,848,490 | 11/1974 | Arel | 83/49 |

*Primary Examiner*—Donald R. Schran
*Assistant Examiner*—James Wolfe
*Attorney, Agent, or Firm*—McCormick, Paulding & Huber

[57] ABSTRACT

A method and apparatus for forming patterns from sheet material employs a castered cutting bit that is guided along a closed cutting path defined by the shape of the desired pattern. The bit is mounted fixedly in a presser foot and projects a predetermined amount below the surface of the foot to control the depth of cut into the material. Frangible materials are cut to depth less than the thickness of the material, and thereafter complete severance of the pattern from the sheet material is accomplished by fracturing the material along the line of cut.

3 Claims, 6 Drawing Figures

METHOD AND APPARATUS FOR FORMING PATTERN PIECES

BACKGROUND OF THE INVENTION

The present invention relates to the field of cutting processes and relates more specifically to a method for cutting patterns from thin sheets of material for use as templates. In the manufacture of apparel, it is well known to cut a fabric material in a multi-ply layup on cutting tables. A marker defining an array of apparel pieces as cut from the layup is initially prepared by manually arranging master patterns for each of the pieces in a manner which makes most effective use of the fabric from which the apparel pieces are eventually cut. The patterns themselves may also be utilized as templates for guiding a cutting tool along a cutting path through the fabric material.

Consequently, it is desirable to prepare patterns or templates from materials which are capable of withstanding the wear and tear of marker making and cutting processes. Such materials typically include paper, cardboard, plastic and sheet metal. Plastic, however, is favored by many manufacturers because it is less expensive than metal and more easily cut, and it is more durable than paper or cardboard.

In the past, plastic patterns have been prepared by either scribing a plastic sheet material in accordance with the shape of a desired pattern or by cutting through the material along a line of cut defining the pattern. Scribing machines that are automatically controlled from a program tape in which the pattern shapes are stored require relatively higher power because the process basically must remove material along the scribing path. On the other hand, the cutting machines utilize a blade which severs the material in a lower power operation as shown, for example, in U.S. Pat. Nos. 3,522,753 and 3,548,699.

It has been found that further improvements in the process of cutting patterns are possible. Lower power consumption can be achieved, and at the same time, the integrity of the machine is more thoroughly protected. It is, accordingly, a general object of the present invention to provide an improved method and apparatus for forming patterns from sheet material.

SUMMARY OF THE INVENTION

The present invention resides in a method and apparatus for forming a pattern from a sheet material. The sheet material is typically cardboard or a styrene plastic that has a limited degree of flexibility and sufficient durability to serve as a reuseable template. The pattern is used in the manufacture of various products including fabric pieces that are eventually assembled in garments and the like.

The method of forming the pattern is comprised basically of placing sheet material of uniform thickness on a smooth support surface in a spread condition for cutting. The sheet material is placed with an upper surface facing away from the support surface and the opposite lower surface facing toward the support surface. A cutting tool suspended above the support surface and the sheet material are then guided relative to one another along a close cutting path defined by the periphery of a desired pattern with the cutting edge of the tool in engagement with the sheet material. The cutting tool in the apparatus preferably includes a cylindrical cutting bit having a sharp leading cutting edge, and the bit is castered to rotate freely about an axis perpendicular to the support surface so that the bit can automatically align itself in the cutting direction at each point along the closed cutting path.

One material which is typically employed as a pattern material is styrene plastic that is supplied in various thicknesses, typically within the range of 0.010–0.050 inch. Such plastic is relatively rigid to serve as a template, but also has sufficient flexibility to permit storage in rolls. The material is also frangible, and within the scope of the present invention, "frangible" means that the material if cut to a depth half its thickness fractures rather than deforms plastically when subjected to high bending stresses along the cut.

The depth of cut through the pattern material is limited to less than the distance between the upper surface of the material and the underlying support surface so that the cutting step does not score the support surface, and, in the case of plastics, so that the step does not sever the pattern completely from the surrounding sheet material or overstress the cutting tool. For this purpose, the cutting bit is fixedly mounted in a presser foot that rests against the upper surface of the material during cutting, and the bit projects from the presser foot by an amount equal to the desired depth of cut through the sheet material.

After frangible material has been cut to a depth less than its thickness along the entire periphery of a pattern, the pattern is separated from the surrounding material by fracturing the frangible material along the closed cutting path. Fracturing is readily accomplished by bending the sheet material at each side of the cut, and with a material such as styrene plastic, a smooth and sharp edge is obtained along the fracture when the depth of cut is approximately half of the thickness of the material.

The cutting apparatus and the novel method of forming patterns by partially cutting through the sheet material and then fracturing the material along the cutting path reduce the amount of power required to prepare a pattern piece in comparison to the prior art cutting processes utilizing either a stylus or a blade that fully penetrates the material. Additionally, with the depth of cut limited to approximately half of the material thickness, there is no scoring or marking of the support surface of the cutting machine, and no intervening protective material is required to prevent damage to the support surface.

DESCRIPTION OF THE PREFERRED EMBODIMENTS

Figure 1:
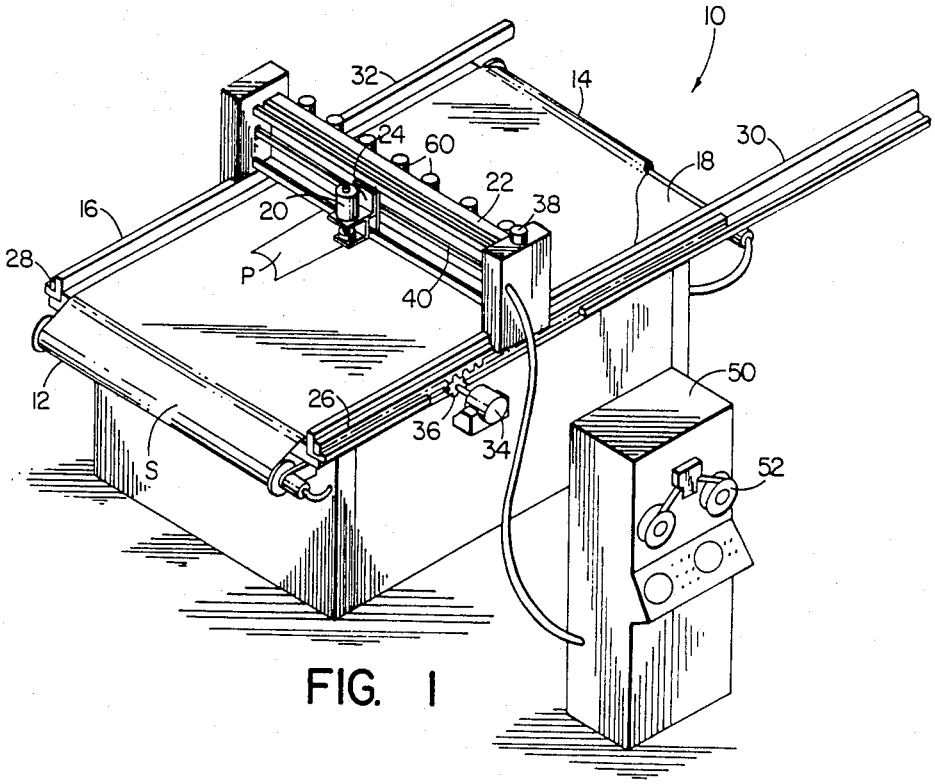
FIG. 1 is a perspective view of an automatically controlled machine for cutting patterns in accordance with the present invention.

FIG. 1 illustrates an automatically controlled machine, generally designated 10, for cutting patterns from a sheet material S stored in rolls 12 and 14 at opposite ends of a cutting table 16. The material is stretched between the rolls along a support surface 18 at the upper side of the table. The support surface is a hard, flat surface and can be formed from metal, wood, composition board, hard plastics or other similar materials.

Mounted above the support surface 18 of the table is a cutting tool 20. The tool is suspended over the sheet material S by means of an X-carriage 22 and Y-carriage 24. The X-carriage 22 moves back and forth over the work surface of the table in the illustrated X-coordinate direction and the Y-carriage 24 is mounted on the X-carriage and moves back and forth in the illustrated Y-coordinate direction. Composite motions of the X- and Y-carriages permit the cutting tool 20 to be moved along various curved cutting paths at any point over the table.

The X-carriage 22 is connected at each side of the table with racks 26, 28. The racks slide in ways 30, 32, respectively, and are driven in unison by means of an X-drive motor 34 through pinions 36 to translate the X-carriage.

The Y-carriage 24 moves back and forth on the X-carriage and is translated by means of a Y-drive motor 38 and a connecting drive belt 40 stretched between opposite ends of the X-carriage. A control computer 50 reads a digital program tape 52 on which the contours of the patterns to be cut in the sheet material S are defined. The computer generates motor command signals from the data on the tape and energizes the drive motors 34, 38 correspondingly. Additionally, the program controls an actuating solenoid which moves the cutting tool 20 into and out of cutting engagement with the sheet material.

A program for cutting multiple patterns may require more sheet material S than that which can be held on the work surface 18 of the table 16. In order to cut all of the patterns, the table has means for intermettently indexing the material across the work surface between the storage rolls 12 and 14. A plurality of coupling mechanisms 60 are attached to the X-carriage 22 and these coupling mechanisms engage the sheet material on command so that the X-carriage can pull the sheet material off of the one roll 12 and allow the material to be wound onto the other roll 14. For further description of the coupling mechanisms and the indexing operation, reference may be had to U.S. Pat. No. 4,091,980 issued to Heinz Joseph Gerber for Apparatus For Advancing Sheet Material. Of course, it should be understood that the indexing apparatus is not essential to the present invention and that one or more patterns may be cut from a single sheet of material that is supported entirely on the work surface 18.

In the illustrated machine 10, the sheet material S may be held on the support surface by clamps, by maintaining tension on the material through the supply rolls 12 and 14 or by incorporating in the table 16 a vacuum system that pulls the sheet material tightly against the support surface 18. Vacuum systems of this type are known and utilized in other pattern cutting machines as described, for example, in U.S. Pat. No. 3,548,699 issued to Gerber et al for A Device For Cutting Sheet Material.

Figure 2:
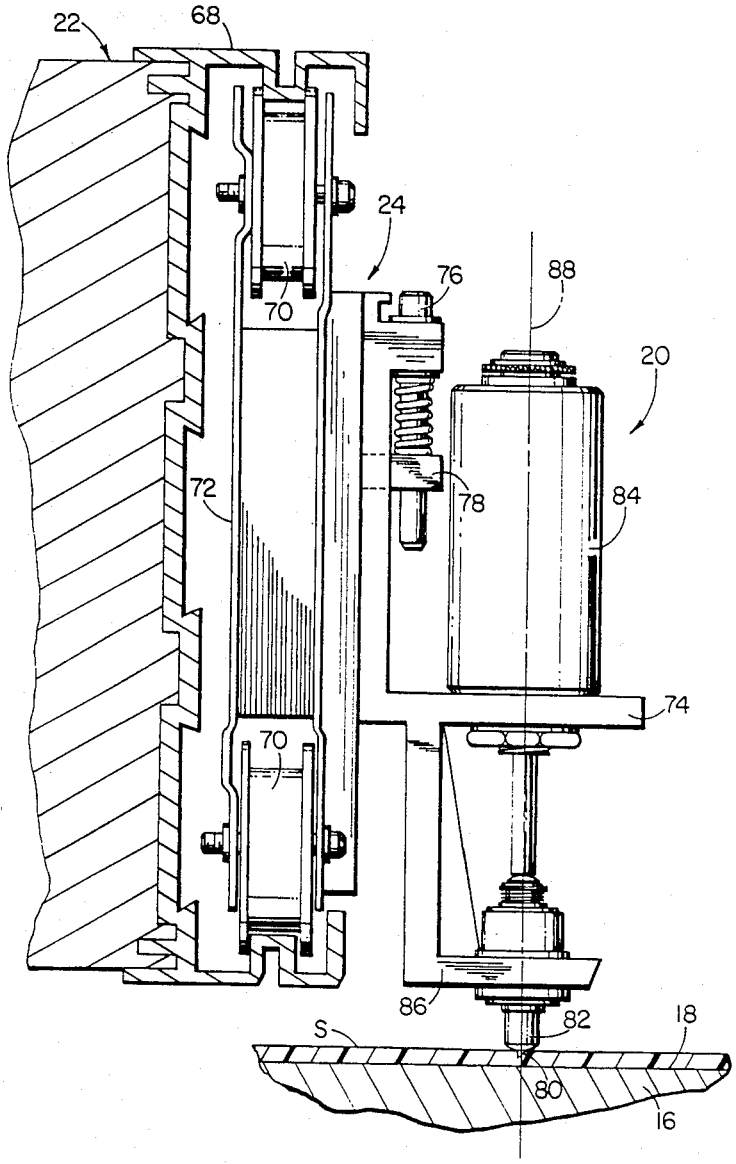
FIG. 2 is an elevation view partially in section showing the cutting tool mounted in the machine of FIG. 1.

FIG. 2 illustrates in detail the mounting of the Y-carriage 24 and the cutting tool 20 to the X-carriage 22. An extruded track 68 is connected to one side of the X-carriage and forms rails for four rollers 70 (only two visible) disposed at each corner of a rectangular frame 72 of the Y-carriage 24. A tool platform 74 is connected to the frame 72 and supports the cutting tool 20 in cantilever fashion above the work surface 18 of the table 16. The platform 74 can be adjusted in elevation relative to the carriage 24 by means of the height-adjustment screw 76 and a lug 78 secured to the frame 72. The height of the platform 74 is set so that the cutting tool 20 penetrates the sheet material S by a limited amount when the tool is lowered in cutting engagement with the material.

The tool is comprised by a cutter bit 80 fixedly mounted in a cylindrical presser foot 82 and an acuating solenoid 84 for pressing the bit downwardly into cutting engagement with the sheet material S. The solenoid 84 is fixedly mounted to the platform 74 while the cutting bit and presser foot are supported in a lower section 86 of the platform.

Figure 3:
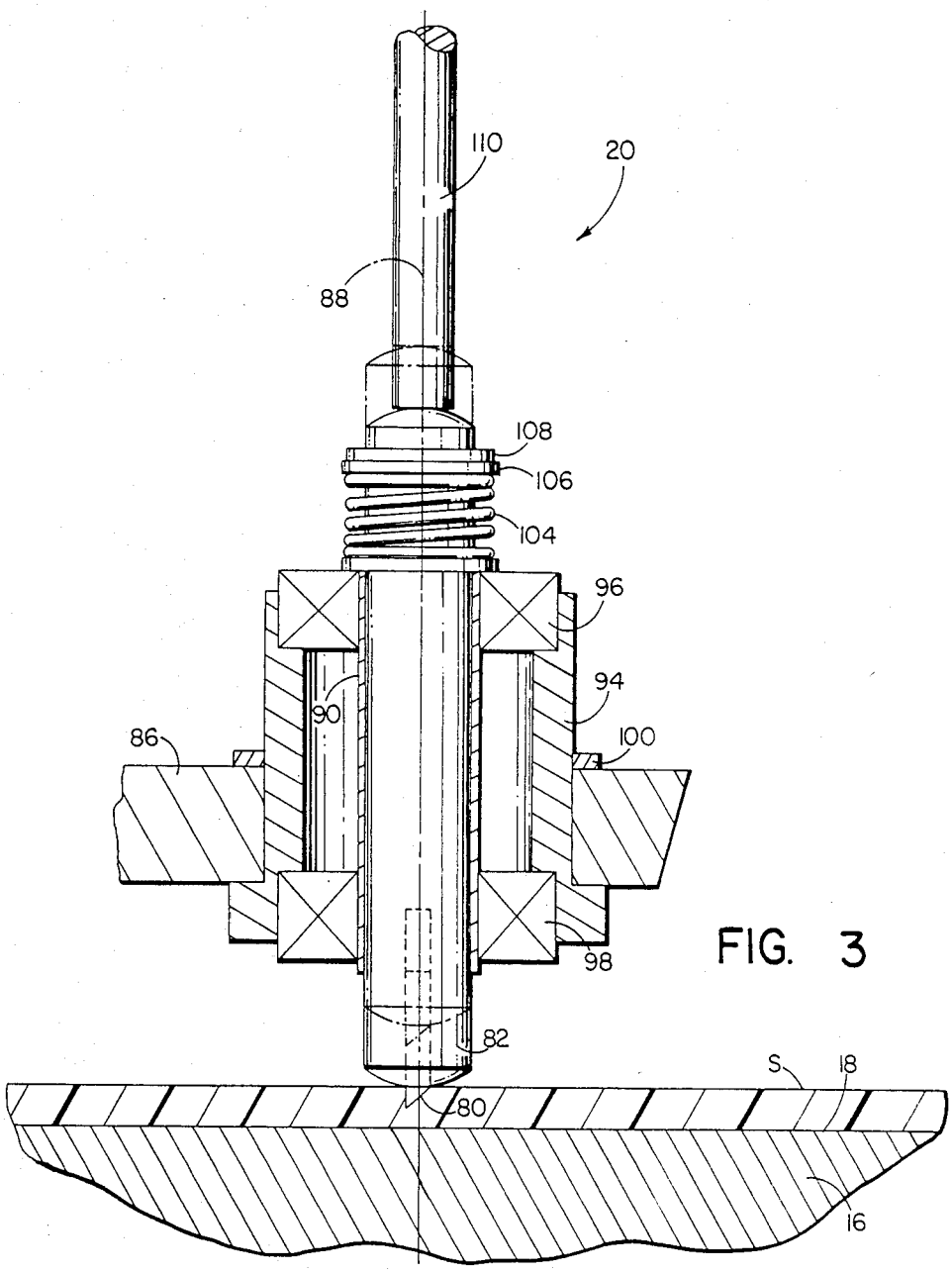
FIG. 3 is a fragmentary view showing the cutting bit and the method of limiting the depth of cut.

As shown most clearly in FIG. 3, the cutter bit 80 and the presser foot 82 are mounted in sliding engagement with a sleeve 90, and the sleeve in turn is journaled within a barrel 94 by means of two bearings 96, 98. The barrel is held fixedly within the section 86 by means of a jam nut 100. In this manner, the presser foot 82 and cutter bit 80 are free to move vertically relative to the sheet material S along the axis 88 perpendicular to the surface 18 and are also free to swivel about the axis 88 within the bearings 96 and 98.

For vertical movement, the presser foot 82 has a circular, cylindrical shape with a sliding fit within the sleeve 90, and a lifting spring 104 engages the upper end of the foot by means of a washer 106 and snap ring 108 to urge the foot and the cutting bit upwardly to the phantom position of FIG. 3. In the elevated position, the cutting bit 80 is disengaged from the sheet material and the cutting tool 20 can thus be moved over the material without cutting.

To lower the cutting bit 80 into cutting engagement with the sheet material S, a steel plunger 110 connected with the armature of the solenoid 84 contacts the upper end of the cylindrical foot 82, and when the solenoid is energized, the plunger presses the bit downwardly to the solid line, lowered position of FIG. 3. It will be observed that in the lowered position the portion of the cutting bit projecting from the foot extends only partially through the material. The lower end of the foot 82 has a convex configuration so that the foot will slide smoothly over the upper surface of the material and maintain a depth of cut equal to the projection of the bit. Preferably, the depth of cut is approximately half of the thickness of the material.

To accommodate materials of different thickness, the entire foot 82 and bit 80 are removed from the sleeve 90 after the solenoid 84 is deenergized and its plunger 110 has been elevated or removed. A new foot with a bit projecting from the lower end by the proper distance is then placed in the sleeve and the solenoid and plunger are returned to the illustrated positions. The same return spring 104 and washer 106 may be employed with each foot and bit.

Figure 4:
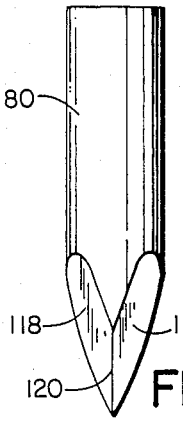
FIGS. 4 and 5 show the mounting of the cutting bit from the front and side, respectively.
Figure 5:
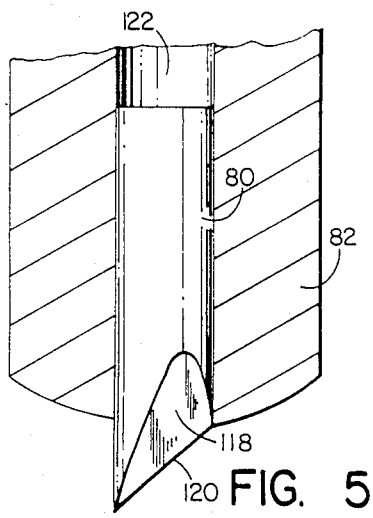

The details of a cutting bit which is secured within the foot 82 are illustrated more particularly in the fragmented elevation views of FIGS. 4 and 5. The bit is preferably made from a circular cylinder of carbide steel or similar hard material, and the depending cutting end of the bit is ground with two intersecting planes or surfaces 116, 118 that define a leading cutting edge 120. The cutting edge is inclined at an angle relative to the upper surface of the sheet material and the support surface 18 of the cutting table when the bit is secured coaxially within the central bore 122 of the foot 82. In one embodiment, the bit 80 is formed from a carbide drill bit blank having a diameter of 0.0625 inch (1/16 inch). The ground surfaces 116 and 118 define an included angle of approximately 19° to form the cutting edge with a resultant inclination relative to the sheet material of approximately 40°. The bit is adhesively secured in the central bore 122 of the foot 82 by a cement, such as Loctite 680 and Primer T manufactured by Loctite Corporation of Newington, Connecticut. Because the bit is so small and the included angle between the surfaces 116 and 118 is also small, the cutting edge is quite sharp and cuts the plastic sheet material S with a severing action as a knife.

With the cutting bit 80 and foot 82 mounted in the bearing 96, 98 as shown in FIG. 3, the projecting portion of the bit is effectively offset from the axis of rotation 88 and free to caster about the axis into alignment with the cutting path without further control of bit orientation. With small bits less than one-quarter inch in diameter, the small degree of curvature created by the castering motion at sharp corners in a pattern is not noticeable nor objectionable. The upper end of the cylindrical foot 82 is also provided with a convex shape that may be polished so that the pressure applied to the bit by the plunger 110 during cutting does not create significant levels of friction that might impede the free castering motion.

In the course of forming a pattern from a frangible sheet material S, the material is placed on the support surface 18 of the cutting table 16, and the cutting tool 20 is moved by the carriages 22 and 24 to a position over the material. The solenoid 84 is actuated and forces the cutter bit 80 and presser foot 82 downwardly in opposition to the lifting spring 104. The lower end of the foot engages the upper surface of the sheet material and limits the depth of penetration of the bit to less than the distance between the upper surface of the material and the support surface 18 as shown in FIGS. 2 and 3. Preferably, the depth of penetration is limited to approximately one-half the thickness of the sheet material S, and this object is achieved by providing presser foots with bits that project by predetermined amounts according to the thickness of the material to be cut.

The cutting bit 80 is then guided along a closed cutting path defined by the periphery of a pattern, and after the bit has completely traversed the periphery, the pattern remains connected with the surrounding sheet material. Such connection facilitates removal of a plurality of patterns cut from a single sheet of material on the table.

Figure 6:
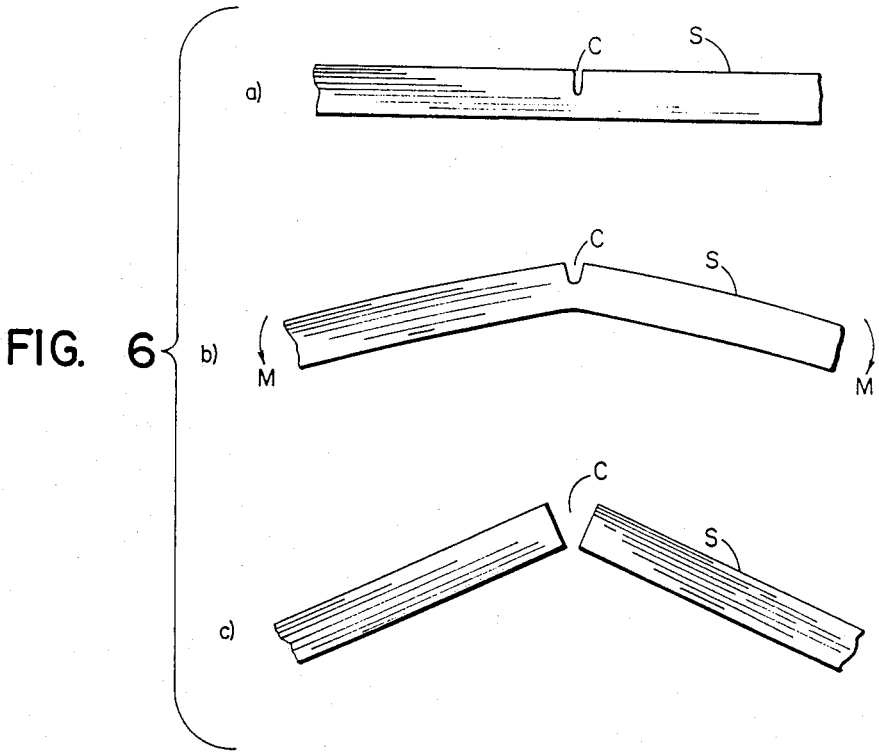
FIG. 6 shows the step of of fracturing frangible sheet material along the line of cut in three sequential views.

The pattern is separated from the surrounding material by fracturing the frangible material along the cutting path. FIG. 6 illustrates the sequence of events that occurs as the cut material is fractured by bending and stressing the material manually or otherwise at the cut C. In view a, the sheet material S is unstressed but is partially severed at the cut C. In view b, an external moment M is applied to the sheet material S across the cut C, and high stress concentrations are thereby created in that portion of the material at the apex of the cut. As the bending moment increases along with the stresses, the fracture strength of the frangible material is exceeded, and the material separates along the cut C as in view c. In practice the bending moment can be created by manually bending the material at sequential, spaced locations along the cutting path until the entire pattern piece is separated from the material. The fracture or break in styrene plastic of 0.030 inch that has been cut approximately half way through remains sharp and clear, and hence defines an edge of the pattern which is quite satisfactory for tracing or guiding cloth cutting blades.

Accordingly, a method and apparatus for forming patterns from a sheet material has been described which utilizes a programmed computer for guiding a cutting tool along a closed cutting path defining the periphery of the pattern. The depth of cut into the material is limited in frangible materials to minimize the amount of power required to advance the cutting blade and also to protect the tool from excessive stress or breakage. Additionally, with partial penetration of the frangible material, the underlying cutting table is not scored or damaged in the process. After the material has been cut to a limited depth, separation of the pattern from the surrounding material is accomplished by fracturing the frangible material along the cutting path.

While the present invention has been described in a preferred embodiment, it should be understood that numerous modifications and substitutions can be made without departing from the spirit of the invention. For example, the cutting apparatus can be used to cut sheet materials which are not frangible by completely penetrating the material and in this event a protective, sacrificial layer of material can be placed between the pattern material and the support surface. The cutting table which holds the sheet material need not be provided with an indexing mechanism and may move either the material or the cutting tool or both to produce relative movement along each coordinate axis. Ideally, the depth of cut in frangible material is limited by fixing the cutting bit within the presser foot, but other depth control mechanisms which regulate the displacement of the bit between its elevated and lowered positions can also be used. Accordingly, the present invention has been described in a preferred embodiment by way of illustration rather than limitation.

I claim:

1. In an apparatus for cutting patterns from a pattern material while the material is held in a spread condition on a support, and a cutting tool and the material are guided relative to one another along a cutting path defined by the pattern periphery, an improved cutting tool comprising a rotatable tool support mounted a predetermined distance above the support surface for movement relative to the surface in a parallel direction, the rotatable support including a sleeve journaled by bearings for free rotation about an axis perpendicular to the material on the support surface, a cylindrical presser foot mounted coaxially within the sleeve and slidable relative to the sleeve along the perpendicular axis toward and away from the support surface; resilient means operatively connected with the cylindrical presser foot for urging the lower end of the presser foot upwardly away from the support surface and material supported thereon, a cutting bit formed from a hard cylindrical member projecting from and fixedly mounted in the lowr end of the cylindrical presser foot in perpendicular relationship with the sheet material to rotate with the foot about the axis perpendicular to the material for alignment with the cutting path, the lower end of the cylindrical member having two ground surfaces intersecting in a sharp cutting edge, which edge extends downwardly toward the support surface at an angle to the perpendicular axis from an upper point at one side of the member and the perpendicular axis to a lowermost point at the opposite side of the member and axis, the cylindrical member projecting from the foot at the lowermost point by a limited amount equal to the desired depth of cut, whereby the cutting bit is mounted relative to the perpendicular axis of rotation of the sleeve for castering movement into alignment with the cutting path when the bit is pressed into cutting relationship with the pattern material and advanced during a cutting operation, and actuator means for urging the cylindrical presser foot and the cutting bit downwardly into cutting engagement with the pattern material in opposition to the resilient means to penetrate the bit into the material up to the lower end of the presser foot during cutting.

2. Apparatus for cutting patterns from pattern material as defined in claim 1 wherein the cylindrical presser foot has an upper end which is smooth and convex for engagement with the actuator means without significant friction to permit the cutting bit and presser foot to freely caster about the axis of rotation.

3. Apparatus for cutting patterns from pattern material as defined in claim 2 wherein the lower end of the cylindrical presser foot from which the cutting bit projects is smooth and rounded.

* * * * *